US012408704B2

(12) United States Patent
Emmett et al.

(10) Patent No.: US 12,408,704 B2
(45) Date of Patent: Sep. 9, 2025

(54) AEROSOL-GENERATING DEVICE WITH PROTECTED AIR INLET

(71) Applicant: Philip Morris Products S.A., Neuchatel (CH)

(72) Inventors: Robert Emmett, Neuchatel (CH); Eva Saade Latorre, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 594 days.

(21) Appl. No.: 17/605,636

(22) PCT Filed: Apr. 24, 2020

(86) PCT No.: PCT/EP2020/061546
§ 371 (c)(1),
(2) Date: Oct. 22, 2021

(87) PCT Pub. No.: WO2020/216943
PCT Pub. Date: Oct. 29, 2020

(65) Prior Publication Data

US 2022/0202095 A1 Jun. 30, 2022

(30) Foreign Application Priority Data

Apr. 25, 2019 (EP) ..... 19171003

(51) Int. Cl.
*A24F 40/485* (2020.01)
*A24F 7/02* (2006.01)

(52) U.S. Cl.
CPC ..... *A24F 40/485* (2020.01); *A24F 7/02* (2013.01)

(58) Field of Classification Search
None
See application file for complete search history.

(56) References Cited

U.S. PATENT DOCUMENTS 11,311,049 B2 * 4/2022 Hawes ..... A24F 40/40
2017/0013878 A1 1/2017 Schuler et al.
(Continued)

FOREIGN PATENT DOCUMENTS

CN 1196660 A 10/1998
CN 106793834 A 5/2017
(Continued)

OTHER PUBLICATIONS

Office Action issued Dec. 5, 2022, in corresponding Japanese Patent Application No. 2021-560097 (with English Translation), 8 pages.
(Continued)

*Primary Examiner* — Ross N Gushi
(74) *Attorney, Agent, or Firm* — Oblon, McClelland, Maier & Neustadt, L.L.P.

(57) ABSTRACT

An aerosol-generating device is provided, including an aerosolisation chamber configured to receive an aerosol-generating article including an aerosol-forming substrate; an air inlet configured such that ambient air may flow therethrough and into the aerosol-generating device; and an airflow path fluidly connecting the air inlet with the aerosolisation chamber, the air inlet being disposed in a recessed portion of an outer surface of the aerosol-generating device, and the recessed portion having a length of more than 10 mm and being configured to prevent blocking of the air inlet by a user. A system is also provided, including the aerosol-generating device and a mouthpiece element.

17 Claims, 7 Drawing Sheets

(56) References Cited

U.S. PATENT DOCUMENTS

| | | | |
|---|---|---|---|
| 2018/0146716 | A1 | 5/2018 | Chen |
| 2018/0271154 | A1 | 9/2018 | Leadley et al. |
| 2018/0303165 | A1 | 10/2018 | Schuler et al. |

FOREIGN PATENT DOCUMENTS

| | | | | |
|---|---|---|---|---|
| CN | 106998815 | A | 8/2017 | |
| CN | 106998819 | A | 8/2017 | |
| CN | 109619698 | A | 4/2019 | |
| JP | 2004-283244 | A | 10/2004 | |
| JP | 2014-519850 | A | 8/2014 | |
| JP | 2017-500100 | A | 1/2017 | |
| RU | 2 597 531 | C2 | 9/2016 | |
| RU | 2 646 737 | C2 | 3/2018 | |
| WO | WO-2013014275 | A2 * | 1/2013 | ..... A24D 1/045 |
| WO | WO 2015/167000 | A1 | 11/2015 | |
| WO | WO 2017/051150 | A1 | 3/2017 | |
| WO | WO 2019/012145 | A1 | 1/2019 | |

OTHER PUBLICATIONS

Chinese Office Action issued Aug. 25, 2023 in Chinese application 2020080026010.6 (filed Apr. 24, 2020), 5 pgs.
International Search Report and Written Opinion issued on Jul. 21, 2020 in PCT/EP2020/061546 filed Apr. 24, 2020, 14 pages.
Russian Search Report issued Jan. 19, 2022, in Russian Patent Application No. 2021122486 (English translation only), 2 pages.

* cited by examiner

AEROSOL-GENERATING DEVICE WITH PROTECTED AIR INLET

The present invention relates to an aerosol-generating device and to a system.

It is known to provide an aerosol-generating device for generating an inhalable vapor. Such devices may heat aerosol-forming substrate to a temperature at which one or more components of the aerosol-forming substrate is volatilised, without burning the aerosol-forming substrate. Such aerosol-forming substrates may be provided as part of an aerosol-generating article. The aerosol-generating article may have a rod shape for insertion of the aerosol-generating article into a cavity, such as a heating chamber of the aerosol-generating device. A heating element may be arranged in or around the heating chamber for heating the aerosol-forming substrate once the aerosol-generating article is inserted into the heating chamber of the aerosol-generating device.

The aerosol-generating device typically comprises an air inlet for allowing ambient air to be drawn from an ambient environment external the aerosol-generating device, into the heating chamber. During use, a user may accidentally block the air inlet with his or her finger or hand. This may negatively influence aerosol generation due to impairing the airflow through the device.

It would be desirable to provide an aerosol-generating device with more reliable aerosol generation. It would be desirable to provide an aerosol-generating device, in which blockage of an air inlet, for example by a hand or digit or a user, is substantially prevented. It would be desirable to provide an aerosol-generating device to which a mouthpiece may be releasably attached, and in which blockage of an air inlet is substantially prevented, for example, by a hand or digit of a user.

According to an aspect of the invention there is provided an aerosol-generating device comprising an aerosolisation chamber. The aerosolisation chamber may be a heating chamber. The aerosolisation chamber may be configured to receive an aerosol-forming substrate. The aerosolisation chamber may be configured to receive an aerosol-generating article comprising aerosol-forming substrate. The aerosol-generating device may comprise an air inlet through which ambient air may flow into the aerosol-generating device. The aerosol-generating device may comprise an airflow path fluidly connecting the air inlet with the aerosolisation chamber. The air inlet may be arranged in a recessed portion of the aerosol-generating device. The recessed portion may be provided in an outer surface of the aerosol-generating device. The recessed portion may be configured to prevent blocking of the air inlet by a user's finger. The recessed portion may be dimensioned to prevent blocking of the air inlet by a user's finger. In some embodiments, the recessed portion may be shaped to prevent blocking of the air inlet by a user's finger. In some embodiments, the recessed portion may be both dimensioned and shaped to prevent blocking of the air inlet by a user's finger.

According to an aspect of the invention there is provided an aerosol-generating device comprising an aerosolisation chamber. The aerosolisation chamber is configured to receive an aerosol-generating article comprising aerosol-forming substrate. The aerosol-generating device comprises an air inlet through which ambient air may flow into the aerosol-generating device. The aerosol-generating device comprises an airflow path fluidly connecting the air inlet with the aerosolisation chamber. The air inlet is arranged in a recessed portion of the aerosol-generating device. The recessed portion is provided in an outer surface of the aerosol-generating device. The recessed portion is dimensioned to prevent blocking of the air inlet by a user's finger.

By providing the air inlet in a recessed portion, a user can hold the device in any position and place his or her fingers on any position of the device without the air inlet getting blocked by a finger of the user. The recessed portion may be configured as a recess. The recessed portion may be configured as a groove. The recessed portion may be configured as a slot. The recessed portion may be configured as a slit. The recessed portion may be configured as a valley. The recessed portion may be configured such that the air inlet is recessed radially inset from the outer surface of the housing of the aerosol-generating device. The recessed portion is shaped, dimensioned, or both shaped and dimensioned to prevent a user's finger from blocking the air inlet. The recessed portion, particularly the air inlet, may thus be substantially out of reach from a user. The recessed portion may have a side profile which prevents a user's finger from penetrating into the recessed portion.

As used herein, an 'aerosol-generating device' relates to a device that interacts with an aerosol-forming substrate to generate an aerosol. An 'aerosol-generating device' may be a smoking device that interacts with an aerosol-forming substrate to generate an aerosol. The aerosol-forming substrate may be part of an aerosol-generating article. The aerosol-generating article may be a smoking article. The aerosol may be directly inhalable by a user, for example into the user's lungs through the user's mouth.

The aerosol-generating device may be portable. The aerosol-generating device may be a handheld device. The device may be configured for holding by a user with one hand. The aerosol-generating device may be sized for holding by a user with one hand. The aerosol-generating device may be shaped for holding by a user with one hand. The aerosol-generating device may be configured for holding by a user with two fingers. The aerosol-generating device may be sized for holding by a user with two fingers. The aerosol-generating device may be shaped for holding by a user with two fingers.

In some embodiments, the aerosol-generating device may be a holder. The holder may be arranged to interact with a charging device. The charging device may be a pocket charger. The charging device may be a portable device. The charging device may be configured to transfer power from a power storage means of the charging device to a power storage means of the holder.

The aerosolisation chamber may be a cavity. The aerosolisation chamber may have a cylindrical cross-section. The aerosolisation chamber may have an elliptical, polygonal or rectangular cross-section. The aerosolisation chamber may be elongate. The aerosolisation chamber may extend along the longitudinal axis of the aerosol-generating device. The aerosolisation chamber may be configured to receive the aerosol-generating article comprising the aerosol-forming substrate. The aerosolisation chamber may be shaped such that the aerosol-generating article can be inserted into the aerosolisation chamber.

An inhalable aerosol may be generated in the aerosolisation chamber. For generating the inhalable aerosol, the aerosol-generating device may comprise an atomizer. The atomizer may be arranged in or at least partly surrounding the aerosolisation chamber. The atomizer may be provided to atomize the aerosol-forming substrate to form the inhalable aerosol. The atomizer may comprise a heating element, in which case the atomizer will be denoted as heating element. Generally, the atomizer may be configured as any device which is able to atomize the aerosol-forming substrate. For example, the atomizer may comprise a nebulizer or an atomizer nozzle based on the venturi effect to atomize the aerosol-forming substrate. Thus, the atomization of the aerosol-forming substrate may be realized by a non-thermally aerosolization technique. A mechanically vibrating vaporiser with vibrating elements, vibrating meshes, a piezo-driven nebulizer or surface acoustic wave aerosolization may be used. In some embodiments, the aerosolisation chamber may be a heating chamber. The aerosol-generating device may comprise a heating element. The heating element may be an electrically powered heating element. In some embodiments, the aerosol-forming substrate or the aerosol-generating article may comprise a heating element.

In some embodiments, none of the device, the aerosol-generating substrate or aerosol-generating article comprises a heating element. Instead an aerosol may be generated by one or more chemical reactions within the aerosolisation chamber.

The air inlet may have a circular, elliptical, polygonal or rectangular cross-section. The air inlet may be configured to allow ambient air to flow through or to be drawn into the aerosol-generating device. The air inlet is preferably provided on the outside of the aerosol-generating device. In this regard, the aerosol-generating device preferably comprises an housing. The air inlet may be provided in the housing. More than one air inlet may be provided. A plurality of air inlets may be provided. The air inlet may comprise a one-way valve to only enable intake of air. The air inlet may be provided at or near a distal end of the aerosol-generating device.

The airflow path may be provided between the air inlet and the aerosolisation chamber. The airflow path may be arranged inside of the aerosol-generating device. The airflow path may have a circular, elliptical, polygonal or rectangular cross-section. The airflow path may be a straight airflow path. The airflow path may be a curved airflow path. The airflow path may be a serpentine airflow path. Further elements may be provided in the airflow path between the air inlet and the aerosolisation chamber. For example, a puff detection system may be arranged in or adjacent to the airflow path. In alternative embodiments, a puff detection system may be arranged at a different position within the aerosol-generating device. In alternative embodiments, there may be no separate puff detection system.

In some embodiments, operation of a heating element as described in more detail below may be triggered by the puff detection system. Alternatively, the heating element may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the aerosolisation chamber or any other passage or chamber within the aerosol-generating device, through which the air flows. When the user draws on the aerosol-generating device, a negative pressure or vacuum is generated inside the device, wherein the negative pressure may be detected by the pressure sensor. The term 'negative pressure' is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

The recessed portion may have a base. In some embodiments, the recessed portion may have at least one sidewall. In some embodiments, the air inlet may be arranged in the base. In some embodiments, the air inlet may be arranged in the sidewall. In some embodiments, the air inlet may be arranged in the transition between the base and the sidewall.

Arranging the air inlet in the base or sidewall may have the advantage that the air inlet is protected. In this regard, if the air inlet would be positioned directly on a flat outside surface of the aerosol-generating device, a user may block the air inlet involuntarily during holding of the aerosol-generating device. Furthermore, an air inlet which is not protected by being placed in the base or sidewall of the recessed portion may be clogged or polluted by unwanted contaminants. This is also prevented or reduced by placing the air inlet in the base or sidewall of the recessed portion. If the air inlet is arranged in the sidewall of the recessed portion, the recessed portion may have a height as described herein larger than the width of a human finger, since the air inlet is protected by the sidewall from being blocked by the finger.

A surface of the sidewall may be perpendicular to the base. Arranging the sidewall perpendicular to the base may facilitate a secure protection of the air inlet arranged in the sidewall. In this regard, a user gripping the aerosol-generating device may be prevented from blocking the air inlet by his or her finger, if the air inlet is arranged in the sidewall and the sidewall is arranged in a perpendicular arrangement. The sidewall may be perpendicular to the outer surface, for example a surface of the housing, of the aerosol-generating device. Preferably, the sidewall creates a step between the outer surface of the housing of the aerosol-generating device and the base of the recessed portion. The outer surface of the housing of the aerosol-generating device may be parallel to the longitudinal axis of the aerosol-generating device. The base of the recessed portion may be parallel to the longitudinal axis of the aerosol-generating device. The sidewall may be perpendicular to the longitudinal axis of the aerosol-generating device.

The recessed portion may have a side cross-sectional profile which prevents a user's finger from penetrating into the recessed portion. The recessed portion may have a u-shaped side cross-sectional profile. The recessed portion may have a side cross-sectional profile of a valley. With such a recess shape, the recess may be bridged by the user's finger without the finger penetrating into the U or valley shape. In this way, the finger cannot completely seal off the air inlet.

The sidewall of the recessed portion may be arranged at the sides of the base. The sidewall may fully surround the base. The base may be recessed with respect to the outside surface of the housing of the aerosol-generating device. The sidewall may be configured as the transition between the outside surface of the housing of the aerosol-generating device and the base of the recessed portion. The recessed portion may have a circular, elliptical, polygonal or rectangular shape.

An angle between the base and the sidewall may be less than 90°, preferably less than 80°, preferably less than 70°. The angle may be measured between the surface of the base and the surface of the sidewall.

In other words, the sidewall may be inclined away from the base such that the sidewall is not fully perpendicular with respect to the base. This may prevent accumulation of unwanted contaminants between the base and the sidewall. This arrangement may also optimize cleaning of the recessed portion, since the transition between the base and the sidewall may be more easily reached with the cleaning tool such as a brush.

A single air inlet may be provided in the base, in the sidewall or in the transition between the base and the sidewall of the recessed portion. Also, multiple air inlets may be provided at different positions along the base, the sidewall and the transition between the base and the sidewall of the recessed portion. By providing multiple air inlets, blocking of the air inlets is even more securely prevented.

The air inlet may be provided with an elongate shape, preferably as a slit. Blockage of the air inlet may be more difficult by providing the air inlet with an elongate shape.

The recessed portion of the aerosol-generating device may comprise a length. The length of the recessed portion may be a longest dimension of the recessed portion. The length of the recessed portion may be measured from a distal most end of the recessed portion to a proximal most end of the recessed portion. The length of the recessed portion may be measured in a tangential direction with respect to the longitudinal axis of the aerosol-generating device. The recessed portion may have a height. The height of the recessed portion may be measured in a direction perpendicular to the length of the recessed portion. The height of the recessed portion may be measured in an axial direction parallel to the longitudinal axis of the aerosol-generating device. The height may be measured at the outer surface of the housing. The recessed portion may comprise a depth. The depth of the recessed portion may be measure in a direction perpendicular to the height of the recessed portion and perpendicular to the length of the recessed portion. The depth of the recessed portion may be measured in a direction from an outer surface of the aerosol-generating device to an innermost portion, preferably to the base, of the recessed portion. The depth of the recessed portion may be measured in a radial direction. The innermost portion of the recessed portion may be radially inset from the outer surface of the aerosol-generating device. The outer surface of the aerosol-generating device may comprise a surface which may be grasped or contacted by a user.

The length of the recessed portion may be larger than an average human finger. The length of the recessed portion may be larger than an average width of a human finger. When referring herein to the length of a human finger and the width of a human finger, it is preferably referred to the typical length and width of a contact area between a human finger and the aerosol-generating device when a user holds the aerosol-generating device. In some embodiments, the length of the recessed portion may be more than 10 mm. In some embodiments, the length of the recessed portion may be more than 15 mm. In some embodiments, the length of the recessed portion may be more than 20 mm.

Providing the recessed portion with such a length may prevent blockage of the air inlet by a user. With such a length, air may still flow from an ambient environment into the recessed area on at least one side of the user's finger and through the air inlet.

In some embodiments, the area of the recessed portion still exposed either side of a user's finger should preferably have a total surface area close to, more preferably equal to or more than, a surface area of the air inlet itself. This may help to provide an RTD of the device within a desirable range.

The height of the recessed portion may be smaller than an average width of a user's finger. The height of the recessed portion may be smaller than 20 mm, preferably smaller than 15 mm, preferably smaller than 10 mm, preferably smaller than 7 mm, more preferably smaller than 4 mm.

Providing the recessed portion with such a height may prevent the user from reaching the base of the recessed portion when placing a finger over the recessed portion. The height of the recessed portion may be measured from sidewall to sidewall of the recessed portion. If the sidewall is not perpendicular, the height of the recessed portion may be measured from the transition between the sidewall and the outer surface of the housing of the aerosol-generating device to the opposite transition of the recessed portion between the sidewall and the outer surface of the housing of the aerosol-generating device. The height of the recessed portion should be chosen to be smaller than the typical width of a finger of the user. Then, a user will not be able to reach the base of the recessed portion if placing the finger on the recessed portion.

By providing the recessed portion with such a height, arrangement of the air inlet in the base of the recessed portion becomes possible. The air inlet may be placed in the base of the recessed portion. If further air inlets are provided, these could be placed also in the base of the recessed portion or in the sidewall of the recessed portion.

The recessed portion may have a depth of at least 0.5 mm, preferably of at least 1 mm, preferably of at least 1.5 mm, more preferably of at least 2 mm. Preferably, the recessed portion has a depth of at least between 1.5 mm and 2.0 mm.

The depth of the recessed portion may be chosen to prevent a user from accidentally blocking the air inlet by his or her finger. If the depth is chosen deep enough, a user may be prevented from reaching the base of the recessed portion by his or her finger. The depth of the recessed portion may be chosen as a function of the height of the recessed portion. If the height is increased, the depth should also increase. If the height increases, a user may reach deeper into the recessed portion when placing a finger over the recessed portion. Consequently, increasing the depth as a function of the height may facilitate that a user may not be able to reach the base of the reasons portion when placing a finger over the recessed portion.

The recessed portion may be arranged on the outside of the aerosol-generating device. If the air inlet is provided in the base or in the sidewall of the recessed portion, ambient air may be drawn into the aerosol-generating device by means of the air inlet.

The recessed portion may have an elongate shape. The recessed portion may extend perpendicular to the longitudinal axis be of the aerosol-generating device.

The aerosolisation chamber may be arranged adjacent the recessed portion. The recessed portion may have a curved configuration curving around the shape of the aerosolisation chamber.

Generally, the outer surface of the aerosol-generating device may be a curved outer surface and the recessed portion may extend around at least a portion of the curved outer surface. The recessed portion may have a curved shape. In embodiments wherein the recessed portion has a curved shape, or the outer housing, the length of the recessed portion referred to herein, may be the tangential length of the recessed portion. In some such embodiments, the tangential length may be more than 10 mm, preferably more than 15 mm, preferably more than 20 mm, more preferably more than 25 mm. The tangential length may be more than between 12 mm and 20 mm. If the tangential length of the recessed portion is larger than the average finger width, a finger may not block the recessed portion, because a finger cannot easily deform around a curve.

The aerosol-generating device may comprise a heating element. The heating element may be arranged to at least partially penetrate an internal portion of aerosol-forming substrate. The heating element may be arranged to at least partially penetrate an internal portion of aerosol-forming substrate of an aerosol-generating article. The heating element may be arranged to externally heat an aerosol-forming substrate. The heating element may be arranged to externally heat an aerosol-generating article comprising aerosol-forming substrate. Where the heating element is arranged for external heating, in some embodiments the heating element at least partly surrounds the aerosolisation chamber. Where the heating element is arranged for external heating, in some embodiments the heating element is arranged to line at least a portion of the aerosolisation chamber. In some embodiments, the heating element may be arranged to directly contact the aerosol-forming substrate or an aerosol-generating article comprising aerosol-forming substrate. This heating element may be denoted as an external heating element. Alternatively or additionally, an internal heating element may be provided.

In all of the aspects of the disclosure, the heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The heating element may be part of an aerosol-generating device. The aerosol-generating device may comprise an internal heating element or an external heating element, or both internal and external heating elements, where 'internal' and 'external' refer to the aerosol-forming substrate. An internal heating element may take any suitable form. For example, an internal heating element may take the form of a heating blade. Alternatively, the internal heater may take the form of a casing or substrate having different electroconductive portions, or an electrically resistive metallic tube. Alternatively, the internal heating element may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the aerosolisation chamber. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The internal or external heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The heating element advantageously heats the aerosol-forming substrate by means of conduction. The heating element may be at least partially in contact with the substrate, or the carrier on which the substrate is deposited. Alternatively, the heat from either an internal or external heating element may be conducted to the substrate by means of a heat conductive element.

Alternatively or additionally to the heating element being configured as an electrically resistive heating element, the heating element may be configured as an inductive heating element. In this case, the heating element comprises an induction coil surrounding a susceptor element. The susceptor element may have the shape of an external or internal heater as described above. When located in an alternating electromagnetic field of the induction coil, typically eddy currents are induced and hysteresis losses occur in the susceptor element causing heating of the susceptor element. Changing electromagnetic fields generated by one or several inductors, for example, induction coils of an inductive heating element heat the susceptor element, which then transfers the heat to the aerosol-forming substrate, such that an aerosol is formed. The heat transfer may be mainly by conduction of heat. Such a transfer of heat is best, if the susceptor element is in close thermal contact with the aerosol-forming substrate.

The susceptor element may be formed from any material that can be inductively heated to a temperature sufficient to generate an aerosol from the aerosol-forming substrate. A preferred susceptor element may comprise or consist of a ferromagnetic material, for example a ferromagnetic alloy, ferritic iron, or a ferromagnetic steel or stainless steel. A suitable susceptor element may be, or comprise, aluminium. Preferred susceptor elements may be heated to a temperature in excess of 250 degrees Celsius.

Preferred susceptor elements are metal susceptor elements, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example iron, cobalt, nickel, or metalloids components such as for example boron, carbon, silicon, phosphorus, aluminium. Preferably, the susceptor material is a metallic susceptor material.

The aerosol-generating device may comprise a connector element for releasably attaching a mouthpiece to the aerosol-generating device.

The connector element may be provided downstream of the aerosolisation chamber. The connector element may be provided at a proximal end of the aerosol-generating device. The connector element may have a through hole, which fluidly connects the aerosolisation chamber with the proximal end of the aerosol-generating device. Aerosol generated in the aerosolisation chamber may flow towards and through the connector element. The connector element may have a cylindrical shape. Surrounding the connector element, a sealing element such as an O-ring may be provided. Multiple sealing elements may be provided surrounding the connector element. The sealing element may facilitate a sealing connection between the connector element and the aerosol-generating device. Alternatively or additionally, a sealing element may be provided at the proximal end of the aerosol-generating device to seal the connection between the connector element and the aerosol-generating device. The connector element may be configured as an integral part of the aerosol-generating device. Alternatively, the connector element may be configured releasably attachable to the proximal end of the aerosol-generating device. The connector element may be provided directly adjacent to the proximal end of the aerosolisation chamber. The connector element may be configured detachable from the aerosol-generating device for insertion of an aerosol-generating article into the aerosolisation chamber. After insertion of an aerosol-generating article into the aerosolisation chamber, the connector element may be attached to the aerosol-generating device thereby securing the aerosol-generating article in the aerosolisation chamber.

A mouthpiece may be configured removably attachable to the connector element. The mouthpiece may be part of the aerosol-generating device. In some embodiments, the mouthpiece is part of a system comprising the aerosol-generating device and the mouthpiece. The connector element may be provided as an integral element of the mouthpiece. Preferably, however, the connector element is provided as a separate element. Providing a separate connector element may enable multiple different mouthpiece is to be connected with a single aerosol-generating device. The mouthpieces may each have different dimensions so as to simulate a feeling between a user's lips of a conventional cigarette, a slim cigarette or a superslim cigarette. The different mouthpieces may be configured to generate different types of aerosol or different usage experiences. Exemplarily, one mouthpiece may be configured to enable a strong usage experience, while a further mouthpiece may be configured to create a smooth usage experience. In this regard, the aerosol may not be fully developed in the aerosolisation chamber of the aerosol-generating device. In some embodiments, the aerosol-forming substrate of the aerosol-generating article is vaporized in the aerosolisation chamber, and the mixture of vaporized aerosol-forming substrate and ambient air drawn into the aerosolisation chamber through the air inlet and the airflow path is delivered towards the mouthpiece. Within the mouthpiece, one or more of cooling, pressurization and expansion of the mixture of vaporized aerosol-forming substrate and ambient air may occur. This influences the development of the aerosol. Consequently, preferably a set of mouthpieces is provided.

By providing the air inlet on a recessed portion of the device housing, rather than in or proximal to a mouthpiece or a mouthend of the device, improved airflow management and resistance to draw (RTD) characteristics may be achieved.

Independent thereof if a single mouthpiece or multiple mouthpieces are provided, the or each mouthpiece may comprise a venturi element. The venturi element may be provided to optimize aerosol generation. The venturi element may be configured to utilize the venturi effect. The venturi element may be dimensions such that the venturi effect occurs, when fluid flows through the venturi element. The venturi element may be configured to utilize or provide the venturi effect. The venturi element may comprise an airflow channel arranged along or parallel to the longitudinal axis of the venturi element. The airflow channel may be a central airflow channel. The venturi element may comprise an air inlet portion, a central portion and an outlet portion. In the inlet portion, the cross-section of the airflow channel may decrease towards the central portion. The cross-section of the airflow channel may be smallest in the central portion. The cross-section of the airflow channel may increase in the outlet portion. The inlet portion may be arranged upstream of the central portion. The outlet portion may be arranged downstream of the central portion. The venturi effect is the reduction of the pressure of a fluid during flow of the fluid through a constricted airflow passage. The venturi element may comprise a constricted airflow passage, also referred to as the central portion. The fluid flowing through the venturi element may be one or more of air, air comprising or entrained with vaporized aerosol-forming substrate and aerosol. After exiting the central portion of the venturi element, the fluid may expand and accelerate, consequently cool down. The cooling of the air may lead to droplet formation and therefore aerosol generation.

By providing the air inlet on a recessed portion of the device housing, rather than in or proximal to a mouthpiece or a mouthend of the device, improved airflow management and resistance to draw (RTD) characteristics in an aerosol-generating system comprising a Venturi element may be achieved.

The connector element may comprise a distal end for enabling the connection between the connector element and the aerosol-generating device. The connector elements may further comprise a proximal end configured for enabling a connection between the connector element and the mouthpiece.

If a separate mouthpiece or separate mouthpieces are provided, the air inlet of the aerosol-generating device is beneficially utilized for drawing ambient air into the aerosol-generating device. Thus, the separate mouthpieces do not have to have air inlets in direct communication with an ambient environment external the aerosol-generating device. Instead, an airflow channel of the mouthpiece may be in communication with the aerosolisation chamber.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within a main body of the aerosol-generating device. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

As used herein, the term 'aerosol-generating article' refers to an article comprising an aerosol-forming substrate which is capable of releasing volatile compounds. The volatile compounds form an aerosol. The aerosol may be directly inhalable by a user, for example into the user's lungs through the user's mouth. In some embodiments, an aerosol-generating article may be a smoking article. In some embodiments, an aerosol-generating article, or at least parts thereof, may be disposable. A smoking article comprising an aerosol-forming substrate comprising tobacco may be referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

In some embodiments, the aerosol-generating article may have a total length between approximately 30 mm and approximately 100 mm. The aerosol-generating article may have an external diameter between approximately 5 mm and approximately 12 mm. The aerosol-generating article may comprise a filter. The filter may be located at a downstream end of the aerosol-generating article. The filter may be a cellulose acetate filter. The filter is approximately 7 mm in length in one embodiment, but may have a length of between approximately 5 mm to approximately 10 mm.

As used herein, the terms 'upstream', 'downstream', 'proximal' and 'distal' are used to describe the relative positions of components, or portions of components, of the aerosol-generating device in relation to the direction in which a user draws on the aerosol-generating device during use thereof. The mouthpiece may be arranged at the downstream end or proximal end of the aerosol-generating device. The heating chamber may be arranged upstream of the mouthpiece. The air inlet may be arranged upstream of the heating chamber. The air inlet may be arranged upstream of the mouthpiece.

In some embodiments, the aerosol-generating article has a total length of approximately 45 mm. The aerosol-generating article may have an external diameter of approximately 7.2 mm. The aerosol-forming substrate may have a length of approximately 10 mm. In some embodiments, the aerosol-forming substrate may have a length of approximately 12 mm. The diameter of the aerosol-forming substrate may be between approximately 5 mm and approximately 12 mm. The aerosol-generating article may comprise an outer paper wrapper. The aerosol-generating article may comprise a separation between the aerosol-forming substrate and the filter. The separation may be approximately 18 mm, but may be in the range of approximately 5 mm to approximately 25 mm.

As used herein, the term 'aerosol-forming substrate' relates to a substrate capable of releasing volatile compounds. The volatile compounds may form an aerosol. Such volatile compounds may be released by heating the aerosol-forming substrate. Such volatile compounds may be released by chemical reaction. In some embodiments, an aerosol-forming substrate may conveniently be part of an aerosol-generating article or smoking article.

In some embodiments, the aerosol-forming substrate may be a solid aerosol-forming substrate. In some embodiments, the aerosol-forming substrate may be a gel aerosol-forming substrate. In some embodiments, the aerosol-forming substrate may be a liquid aerosol-forming substrate. In some embodiments, the aerosol-forming substrate may comprise both solid and liquid components. In some embodiments, the aerosol-forming substrate may comprise both solid and gel components. In some embodiments, the aerosol-forming substrate may comprise both gel and liquid components. In some embodiments, the aerosol-forming substrate may comprise solid, liquid and gel components. In some embodiments, the aerosol-forming substrate may comprise a tobacco-containing material containing volatile tobacco flavour compounds which are released from the substrate upon heating. In some embodiments, the aerosol-forming substrate may comprise a non-tobacco material.

In some embodiments, the aerosol-forming substrate may comprise an aerosol former.

An aerosol former facilitates the formation of aerosol, for example, a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of:

herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may comprise additional tobacco or non-tobacco volatile flavour compounds, which may be released upon heating of the substrate or reacting the substrate with a reactant. The solid aerosol-forming substrate may comprise capsules which, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise combining one or both of tobacco leaf lamina and tobacco leaf stems. In some embodiments, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred embodiment, the aerosol-forming substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

In some embodiments, the aerosol-forming substrate may be provided in a liquid form. The liquid aerosol-forming substrate may comprise other additives and ingredients, such as flavourants. The liquid aerosol-forming substrate may comprise water, solvents, ethanol, plant extracts and natural or artificial flavours. The liquid aerosol-forming substrate may comprise nicotine. The liquid aerosol-forming substrate may have a nicotine concentration of between about 0.5% and about 10%, for example about 2%. The liquid aerosol-forming substrate may be contained in a liquid storage portion of the aerosol-generating article, in which case the aerosol-generating article may be denoted as a cartridge.

According to another aspect of the invention, there is provided a system comprising an aerosol-generating device as described above and first mouthpiece element as described above. In some embodiments, the system may comprise at least a second mouthpiece element as described above. The first mouthpiece element and the second mouthpiece element may differ in one or more respects, as above described. In some embodiments, the system comprises an aerosol-forming substrate. In some embodiments, the system comprises an aerosol-generating article comprising aerosol-forming substrate.

The invention further relates to a set of mouthpieces as described above configured releasably attachable to the connector element of the aerosol-generating device as described above.

The invention further relates to a system comprising an aerosol-generating device as described above and a set of mouthpieces as described above.

The invention may further relate to a method for providing one or more of an aerosol-generating device as described above, a mouthpiece as described above, an aerosol-generating article as described above, a set of mouthpieces as described above, a system comprising an aerosol-generating device as described above and an aerosol-generating article as described above and a system comprising a set of mouthpieces as described above and an aerosol-generating article as described above.

Features described in relation to one aspect may equally be applied to other aspects of the invention.

The invention will be further described, by way of example only, with reference to the accompanying drawings in which.

Figure 1:
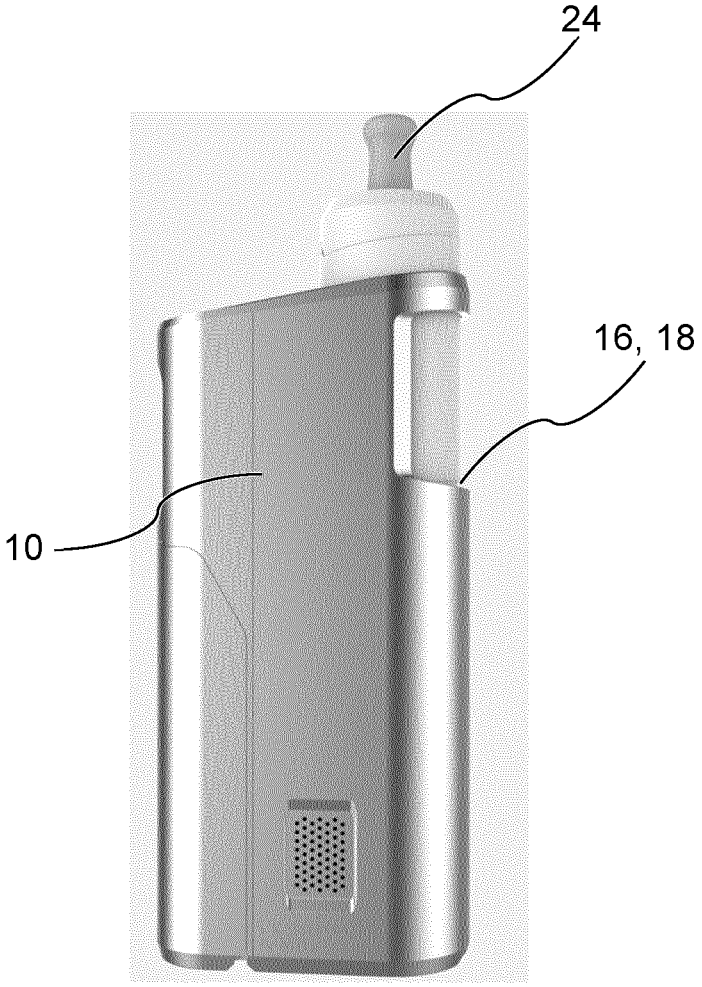
FIG. 1 shows a perspective view of an aerosol-generating device.
Figure 5:
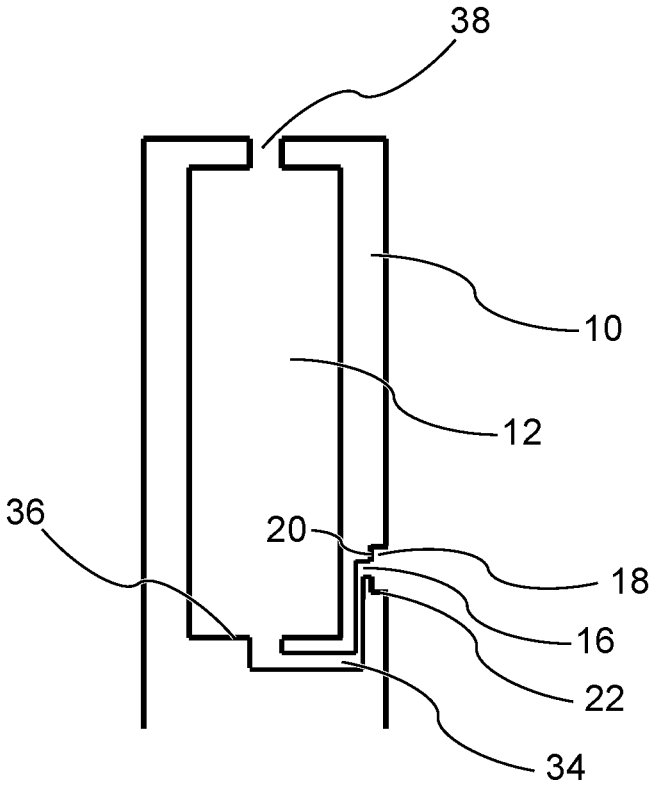
FIG. 5 shows a cross-sectional view of the aerosol-generating device and an airflow channel through the aerosol-generating device.
Figure 7:
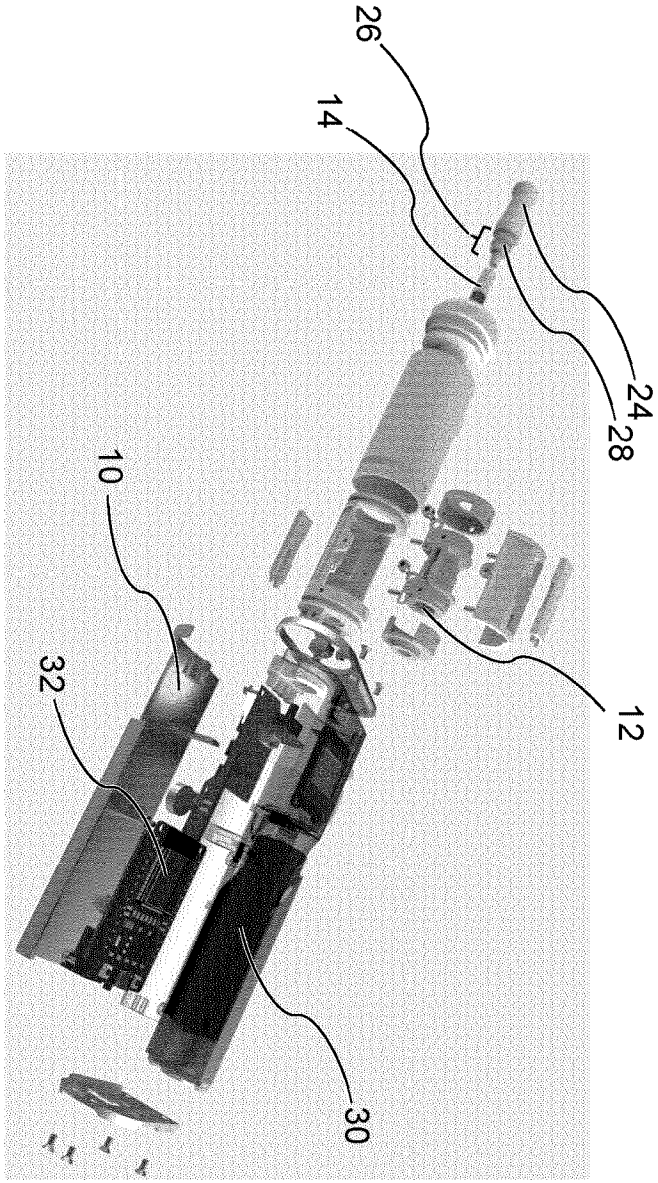
FIG. 7 shows an exploded view of the aerosol-generating device of FIGS. 1 and 2.

FIG. 1 shows an aerosol-generating device with a housing 10. Within the aerosol-generating device, as depicted in FIGS. 5 and 7, an aerosolisation chamber 12 is provided. Within the aerosolisation chamber 12, an aerosol-generating article 14 comprising aerosol-forming substrate can be received for generating an inhalable aerosol.

For generating the aerosol, an external heating element is provided at least partly surrounding or lining the aerosolisation chamber 12. Ambient air can be drawn through an airflow channel 34 depicted in FIGS. 5 and 6 into the aerosolisation chamber 12 by means of an air inlet 16. The air inlet 16 is provided in a recessed portion 18. The recessed portion 18 is recessed with respect to the outer surface of the housing 10 of the aerosol-generating device.

Figure 2:
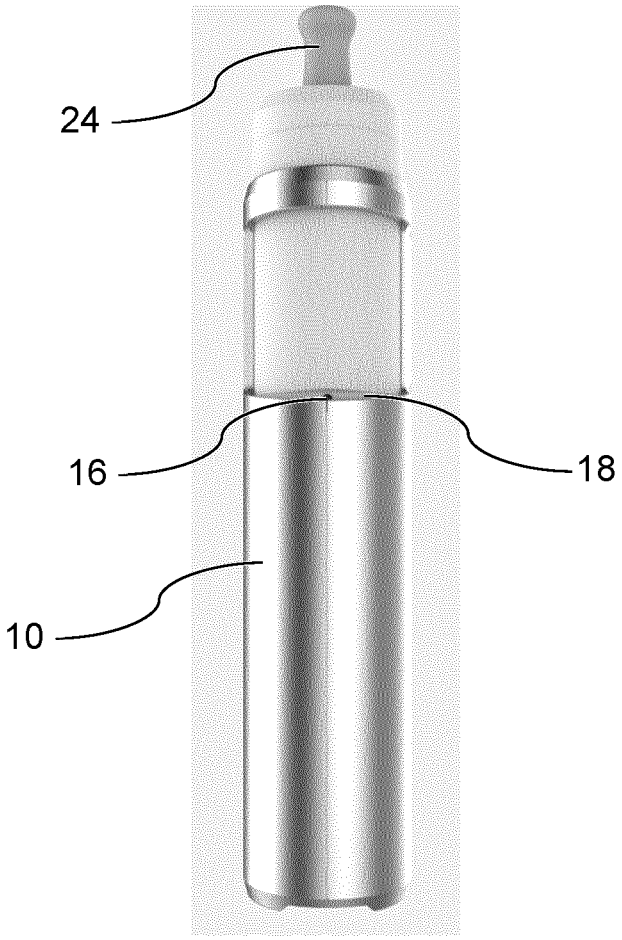
FIG. 2 shows a side view of the aerosol-generating device of FIG. 1.

As can be seen in FIG. 2, the recessed portion 18 has an elongate shape essentially perpendicular to the longitudinal axis of the aerosol-generating device. A step is formed between the outer surface of the housing 10 of the aerosol-generating device and the recessed portion 18 by means of a sidewall 22 of the recessed portion 18. The sidewall 22 and a base 20 of the recessed portion 18 are depicted in more detail in below described FIGS. 3 and 4. This step protects the air inlet 16 from an unwanted blocking of the air inlet 16 by the finger of the user, when the user holds the aerosol-generating device.

In FIGS. 1 and 2, in addition to the aerosol-generating device, a mouthpiece 24 is depicted. The mouthpiece 24 is provided as a separate element from the aerosol-generating device. The connection between the mouthpiece 24 and the aerosol-generating device is provided by means of a connector element 26 as depicted in FIG. 7. The connector element 26 may comprise one or more grooves 28, in which a sealing element such as an O-ring can be arranged. The connector element 26 may be provided proximal of the aerosolisation chamber 12. The connector element 26 may be removably detachable from the aerosol-generating device such that an aerosol-generating article 14 can be inserted into the aerosolisation chamber 12 of the aerosol-generating device and, subsequently, the connector element 26 can be connected with the proximal end of the aerosol-generating device so as to hold the aerosol-generating article 14 securely in the aerosolisation chamber 12 of the aerosol-generating device.

The separation of the mouthpiece 24 and the aerosol-generating device is optimized by providing the air inlet 16 in the aerosol-generating device and not in the mouthpiece 24. By this separation, no airflow path has to be provided between the mouthpiece 24 and the aerosolisation chamber 12 of the aerosol-generating device except for the airflow path through which the aerosol is drawn from the aerosolisation chamber 12 to the mouthpiece 24 and through the mouthpiece 24 into the mouth of the user. The construction of the mouthpiece 24 can therefore be simplified. At the same time, an unwanted blockage of the air inlet 16 is prevented by placing the air inlet 16 in the recessed portion 18. A further advantage of the separation between the mouthpiece 24 and the aerosol-generating device is that multiple different mouthpieces 24 can be attached to the aerosol-generating device by means of the connection element so that different usage experiences can be chosen by a user by an appropriate mouthpiece 24.

Figure 3:
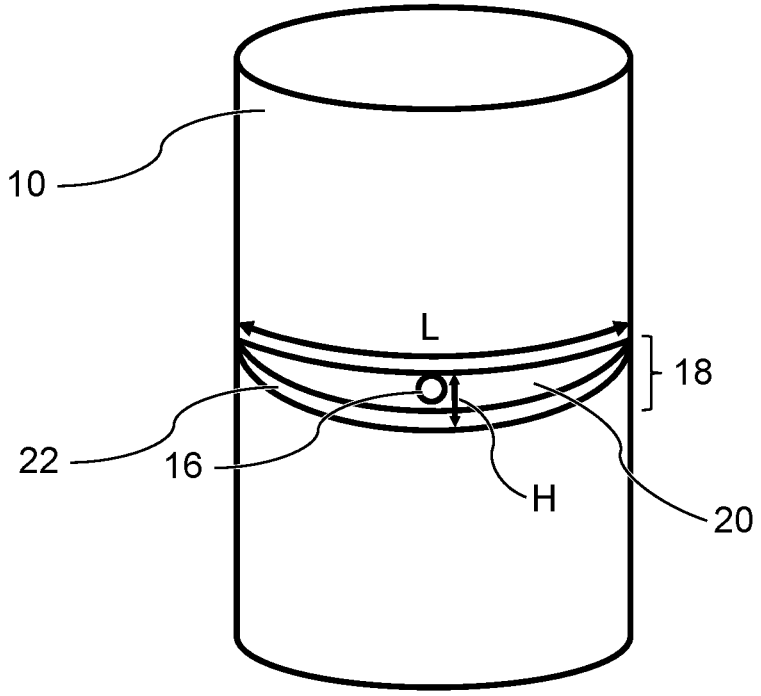
FIG. 3 shows an illustrative side view of a recessed portion comprising an air inlet.
Figure 4:
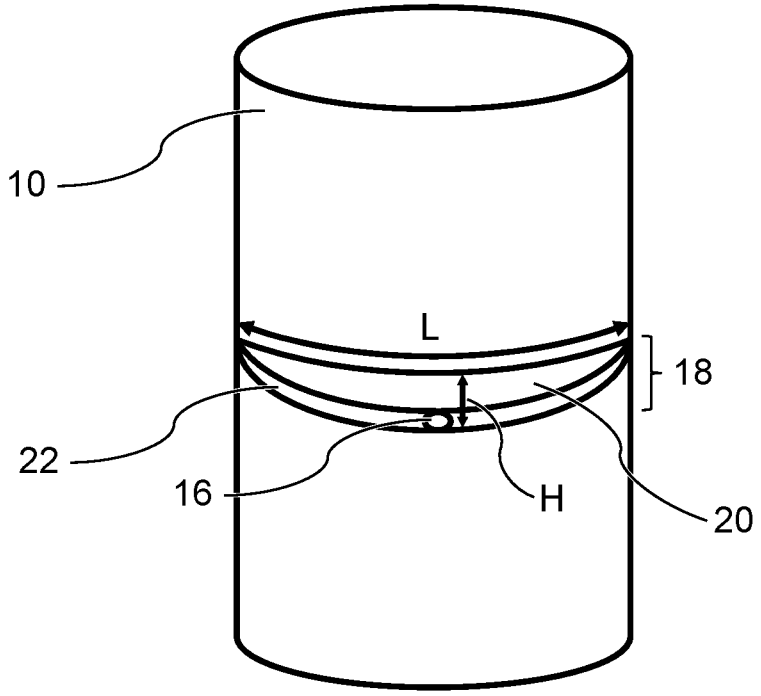
FIG. 4 shows an illustrative side view of the recessed portion with the air inlet arranged in a side wall of the recessed portion.

In FIG. 3, an illustrative side view of the recessed portion 18 and the air inlet 16 is depicted. The recessed portion 18 is recessed with respect to the outer surface of the housing 10 of the aerosol-generating device. The recessed portion 18 has an elongate shape with a length L. The recessed portion 18 comprises the base 20 and the sidewall 22. The sidewall 22 is preferably oriented in a plane perpendicular to the longitudinal axis of the aerosol-generating device. The base 20 is preferably oriented in a plane parallel to the longitudinal axis of the aerosol-generating device. The base 20 is preferably recessed radially inwards in comparison to the outer surface of the housing 10 of the aerosol-generating device. The air inlet 16 may be arranged in the base 20 as depicted in FIG. 3. Alternatively, the air inlet 16 may be arranged in the sidewall 22 as depicted in FIG. 4 or in the transition between the base 20 and the sidewall 22. The recessed portion 18 is preferably curved. The curvature of the recessed portion 18 and the length L of the recessed portion 18 is configured such that air may flow into the recessed portion 18 and into the air inlet 16 even if a user has placed a finger over the recessed portion 18. In this case, due to the curvature and length L of the recessed portion 18, the air may flow into the recess either side of the finger of the user and under the finger of the user into the inlet 16. Preferably, the recess has a maximum height H, which is short enough that the finger acts to bridge, rather than fill, the gap in the outer housing created by the recess.

FIG. 4 shows an alternative arrangement of the air inlet 16 in the sidewall 22 instead of the base 20 as shown in FIG. 3. Generally, more than one air inlet 16 may be provided. One or more air inlets 16 may be provided in the sidewall 22. One or more air inlets 16 may be provided in the base 20. One or more air inlets 16 may be provided in the transition between the base 20 and the sidewall 22.

FIG. 5 shows a cross-sectional view of the aerosol-generating device with respect to the airflow channel 34 through the aerosol-generating device. In FIG. 5, the recessed portion 18 comprising the air inlet 16 is depicted adjacent to the aerosolisation chamber 12. However, the recessed portion 18 and the air inlet 16 may also be arranged upstream of the aerosolisation chamber 12. The air inlet 16 is fluidly connected with the aerosolisation chamber 12 by means of the airflow channel 34. In the embodiment depicted in FIG. 5, the airflow channel 34 fluidly connects the air inlet 16 to a base 36 of the aerosolisation chamber 12. At the base 36 of the aerosolisation chamber 12, ambient air may thus enter into the aerosolisation chamber 12. Within the aerosolisation chamber 12, an aerosol-generating article 14 may be placed, which is not depicted in FIG. 5. After becoming entrained with vaporized aerosol-forming substrate to form an aerosol, the aerosol may flow out of the aerosolisation chamber 12 through outlet 38. Through the outlet 38, air comprising vaporized aerosol-forming substrate may flow towards the mouthpiece 24 (not shown in FIG. 5).

Figure 6:
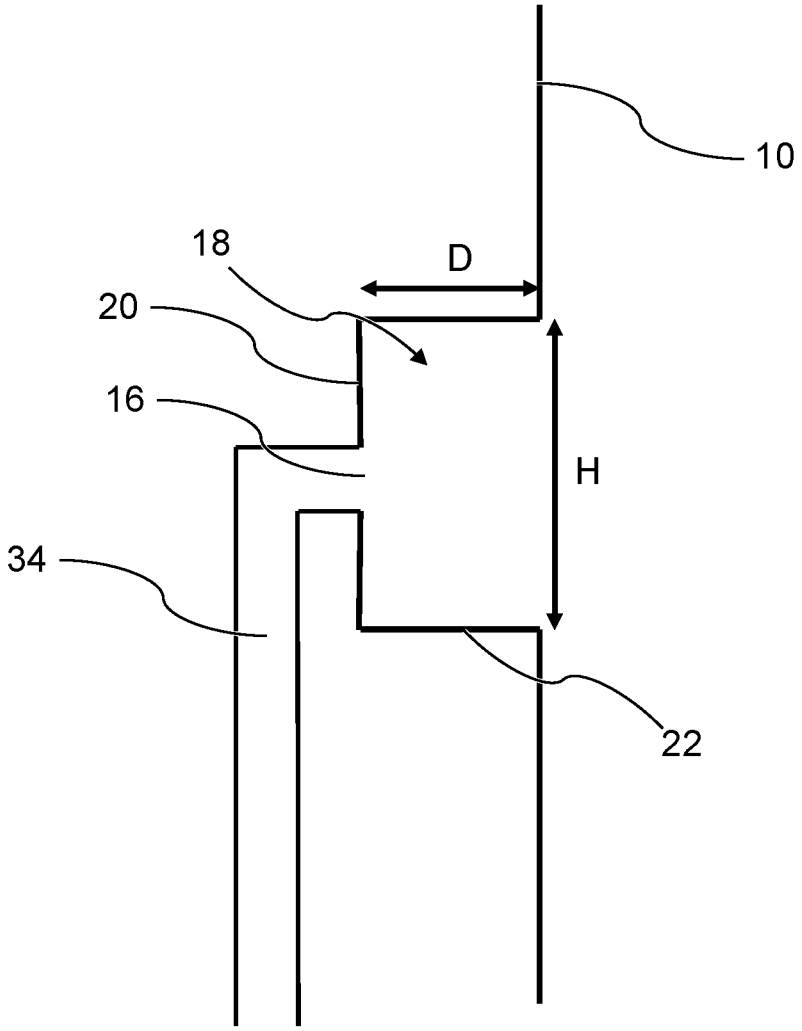
FIG. 6 shows a cross-sectional view of the recessed portion and the air inlet.

FIG. 6 shows a more detailed cross-sectional view of the recessed portion 18 comprising the air inlet 16. Particularly, the dimensions of the recessed portion 18 are indicated. This regard, the recessed portion 18 comprises the height H and a depth D. The height H and the depth D are both measured perpendicular to the length L of the recessed portion 18 as indicated in FIG. 3. The height H is configured smaller than a width of a finger of the user such that a user will not block the air inlet 16 when placing a finger over the recessed portion 18. Depth D may be selected so that, in view of height H, the finger may not deform and fill the recess to block the air inlet 16. Instead, the finger will function to bridge the gap H.

In the right part of FIG. 6, a main body of the aerosol-generating device is depicted which may comprise further components of the aerosol-generating device such as a battery 30 and electric circuitry 32. Additionally, FIG. 7 shows the mouthpiece 24 having a connection portion 26 comprising a groove 28 in which a sealing element in the form of an O-ring is received. The O-ring is arranged to seal about the external portion of the mouthpiece 24, relative to the aerosol-generating device. The mouthpiece 24, in some embodiments, comprises a venturi element. Therefore sealing of the mouthpiece relative to the device is of paramount importance.

The invention claimed is:

1. An aerosol-generating device, comprising:

an aerosolisation chamber configured to receive an aerosol-generating article comprising an aerosol-forming substrate;

an air inlet configured such that ambient air may flow therethrough and into the aerosol-generating device;

an airflow path fluidly connecting the air inlet with the aerosolisation chamber, wherein the air inlet is disposed in a recessed portion of an outer surface of the aerosol-generating device, and wherein the recessed portion comprises a length of more than 10 mm and is configured to prevent blocking of the air inlet by a user; and a housing, wherein the recessed portion is provided in an outer surface of the housing, wherein the outer surface of the housing is parallel to a longitudinal axis of the aerosol-generating device, wherein the recessed portion further comprises a base and at least one sidewall, wherein the base of the recessed portion is parallel to the longitudinal axis of the aerosol-generating device, wherein the sidewall is inclined away from the base such that the sidewall is not perpendicular with respect to the base, wherein the air inlet is arranged in the sidewall or in a transition between the base and the sidewall.

2. The aerosol-generating device according to claim 1, wherein the recessed portion comprises a length of more than 15 mm.

3. The aerosol-generating device according to claim 1, wherein the recessed portion comprises a length of more than 25 mm.

4. The aerosol-generating device according to claim 1, wherein the outer surface is a curved outer surface and the recessed portion extends around at least a portion of the curved outer surface.

5. The aerosol-generating device according to claim 1, wherein the sidewall is inclined away from the base such that an angle between the base and the sidewall is less than 70°.

6. The aerosol-generating device according to claim 1, wherein the recessed portion has a height that is smaller than 20 mm.

7. The aerosol-generating device according to claim 1, wherein the recessed portion has a height that is smaller than 4 mm.

8. The aerosol-generating device according to claim 1, wherein the recessed portion has a depth of at least 0.5 mm.

9. The aerosol-generating device according to claim 1, wherein the recessed portion has a depth of at least 2 mm.

10. The aerosol-generating device according to claim 1, wherein the recessed portion has an elongate shape.

11. The aerosol-generating device according to claim 1, wherein the recessed portion extends perpendicular to the longitudinal axis of the aerosol-generating device.

12. The aerosol-generating device according to claim 1, wherein the recessed portion is slit-shaped.

13. The aerosol-generating device according to claim 1, further comprising a heating element at least partly lining the aerosolisation chamber.

14. The aerosol-generating device according to claim 1, further comprising a connector element configured to releasably attach a mouthpiece to the aerosol-generating device.

15. A system, comprising:

an aerosol-generating device according to claim 1; and a first mouthpiece element.

16. The system according to claim 15, further comprising an aerosol-generating article comprising an aerosol-forming substrate.

17. The system according to claim 15, further comprising at least a second mouthpiece element, wherein the first mouthpiece element and second mouthpiece element have one or more different characteristics.

* * * * *